US009742127B2

(12) United States Patent
Magee, Jr.

(10) Patent No.: US 9,742,127 B2
(45) Date of Patent: Aug. 22, 2017

(54) POWER STRIPS

(71) Applicant: Kimball P. Magee, Jr., Duluth, GA (US)

(72) Inventor: Kimball P. Magee, Jr., Duluth, GA (US)

( * ) Notice: Subject to any disclaimer, the term of this patent is extended or adjusted under 35 U.S.C. 154(b) by 310 days.

(21) Appl. No.: 14/703,683

(22) Filed: May 4, 2015

(65) Prior Publication Data

US 2015/0236453 A1 Aug. 20, 2015

Related U.S. Application Data

(63) Continuation-in-part of application No. 13/222,879, filed on Aug. 31, 2011, now Pat. No. 9,024,472.

(51) Int. Cl.

| | |
|---|---|
| ***H01H 31/10*** | (2006.01) |
| ***H01H 33/52*** | (2006.01) |
| ***H01H 33/59*** | (2006.01) |
| ***H01H 47/00*** | (2006.01) |
| ***H01H 85/46*** | (2006.01) |
| ***H01H 19/14*** | (2006.01) |
| ***H01R 13/70*** | (2006.01) |
| ***H01R 13/66*** | (2006.01) |
| ***H01R 25/00*** | (2006.01) |
| ***H01H 3/14*** | (2006.01) |

(52) U.S. Cl.

CPC ..... *H01R 13/70* (2013.01); *H01H 3/14* (2013.01); *H01R 13/6691* (2013.01); *H01R 25/003* (2013.01); *Y10T 307/477* (2015.04)

(58) Field of Classification Search

USPC ..... 307/113, 115

See application file for complete search history.

(56) References Cited

U.S. PATENT DOCUMENTS 5,424,903 A * 6/1995 Schreiber ..... G06F 1/266 307/40
6,741,442 B1 * 5/2004 McNally ..... G06F 1/206 307/41
7,171,461 B2 * 1/2007 Ewing ..... G06F 1/26 307/11
7,625,242 B2 * 12/2009 Axland ..... H01R 25/006 439/640

(Continued)

OTHER PUBLICATIONS

Amazon.com website: http://www.amazon.com/Woods-Foot-Switch-Power-Strip/dp/B001DELQ06; printed Sep. 1, 2011; pp. 1-5.

(Continued)

*Primary Examiner* — Adam Houston

(74) *Attorney, Agent, or Firm* — Brient Globerman, LLC; Kyle M. Globerman

(57) ABSTRACT

A power strip having two or more powers strips daisy chained together where each of the two or more power strips include a sequence control module operable to sequentially activate and/or deactivate the outlets, thereby powering up or powering down each outlet separately across the two or more power strips. A pre-determined time delay, that can be set by a user, occurs between the activation and/or deactivation of the outlets. The sequence control module of each power strip is operatively coupled to the sequence control module of the subsequent next power strip so that one power strip can be used to trigger activation of the next power strip.

20 Claims, 7 Drawing Sheets

(56) References Cited

U.S. PATENT DOCUMENTS

| | | | | |
|---|---|---|---|---|
| 2009/0322160 | A1* | 12/2009 | DuBose | H02J 9/005 307/131 |
| 2010/0145542 | A1* | 6/2010 | Chapel | G05B 15/02 700/295 |
| 2011/0241443 | A1* | 10/2011 | DuBose | H02J 9/005 307/126 |
| 2012/0239773 | A1* | 9/2012 | Blustein | H04L 12/2818 709/208 |
| 2013/0052872 | A1* | 2/2013 | Magee, Jr. | H01R 25/003 439/620.21 |
| 2015/0066227 | A1* | 3/2015 | Chapel | H04L 12/4633 700/295 |
| 2015/0130276 | A1* | 5/2015 | McNeill-McCallum | H02J 3/00 307/23 |
| 2015/0236453 | A1* | 8/2015 | Magee, Jr. | H01R 13/70 307/40 |
| 2016/0149331 | A1* | 5/2016 | Chen | H01R 13/465 439/491 |
| 2016/0315465 | A1* | 10/2016 | Ferguson | H01R 13/70 |

OTHER PUBLICATIONS

Atlas Sound website: http://www.atlassound.com/pn/SACR-191; printed Sep. 1, 2011; one page.

ProAVmax.com website: http://proavmax.com/FURMAN-PS-8R-11-Power-Conditioner-and-Sequencer-p/frmn-ps8rii.htm; printed Sep. 1, 2011; pp. 1-5.

* cited by examiner

POWER STRIPS

CROSS-REFERENCE TO RELATED APPLICATION

This application is a continuation-in-part of U.S. patent application Ser. No. 13/222,879, filed Aug. 31, 2011, which is hereby incorporated by reference herein in its entirety.

BACKGROUND

This specification is related generally to power strips.

A conventional power strip includes two or more electrical outlets (or sockets) that electrical devices can plug into. The power strip, in turn, receives power through its power cable from a single socket, thereby permitting the electrical devices plugged into the power strip to share a power source. In addition to permitting multiple electrical devices to receive power from a single socket, power strips also typically include surge protection circuits to protect electrical devices plugged into the strip from electricity surges. These circuits protect electrical devices plugged into the power strip from sudden spikes in power by acting as high speed switch to limit peak power to the electrical sockets when surges are detected.

Despite the advantages power strips provide in permitting multiple electrical devices to be close proximity by sharing a single socket, while sometimes providing features like surge protection, the use of many electrical devices drawing power from or through a common source can result in problems. One such problem is overloading, which is caused when electrical devices draw more power from a power source than is available. Even if a power strip includes overload protection to prevent it taking more power than it is intended to supply, high current-drawing electrical devices can cause circuit breakers to trip, such as home circuit breakers. This can result in damage to electrical devices plugged into the power strip, and the de-energizing of other electrical devices sharing the same circuit breaker. This problem may be exacerbated when multiple electrical devices that pull significant current are connected to a single power strip. Another problem are electrical surges, which can be harmful to electrical devices and can occur when multiple devices are simultaneously turned on or off, as often occurs when a conventional power strip is turned on or off.

SUMMARY

In general, in various embodiments, a power strip comprises a first power strip. The first power strip comprises a first housing, a first plurality of outlets disposed in the first housing and operable to each receive a plug. The first power strip also comprises a first controller operable to activate each one of the plurality of outlets in a first sequence based on input received by the first controller. In one or more embodiments, the first power strip comprises a control signal source selected form a group consisting of: (1) a first plurality of digital encoders; (2) a first wireless chip that is operatively coupled to the first controller and configured to receive input commands from and transmit data to a remote computing device; (3) a first wired port that is operatively coupled to the first controller; and (4) a first foot switch. The power strip also comprises a second power strip comprising a second housing, a second plurality of outlets disposed in the second housing and operable to each receive a plug, and a second control module operable to activate each one of the plurality of outlets in a second sequence based on input received by the first controller. The second power strip also comprises one or more second control signal sources selected from a group consisting of: (1) a second plurality of digital encoders; (2) a second wireless chip that is operatively coupled to the second controller and configured to receive input commands from and transmit data to the remote computing device; (3) a second wired port that is operatively coupled to the second controller; and (4) a second foot switch. The first controller is operatively coupled to the second controller. The first controller is operable to activate the first plurality of outlets in a first sequence. The second controller is operable to activate the second plurality of outlets in a second sequence based at least in part on the first sequence.

In general, in various embodiments, a method of connecting a plurality of power strips to one another comprises providing a first power strip. The first power strip comprises a first housing. The first power strip also comprises a first plurality of outlets disposed in the first housing and operable to each receive a plug. The first power strip comprises a first controller operable to activate each one of the first plurality of outlets in a first sequence based on a first control signal received by the first controller. The first power strip also comprises a first control signal source that is configured to provide the first control signal to the first controller. The method also comprises providing a second power strip comprising a second housing and a second plurality of outlets disposed in the second housing and operable to each receive a plug. The second power strip comprises a second controller operable to activate each one of the second plurality of outlets in a second sequence based on a second control signal received by the second controller. The second power strip also comprises a second control signal source that is configured to provide the second control signal to the second controller. The method further comprises programming the first controller to activate the first plurality of outlets based at least in part on a first sequence that comprises a first time delay and programming the second controller to activate the second plurality of outlets based at least in part on a second sequence that comprises a second time delay. The method also comprises operatively coupling the second controller to the first power strip. The method comprises activating the first controller to turn on the first plurality of outlets based at least in part on the first sequence and the first time delay and activating the second controller to turn on the second plurality of outlets based at least in part on the second sequence, the second time delay and the first sequence.

Overview

The present invention relates to a power strip that can sequentially power-up and power-down outlets.

In a first aspect, a power strip includes a housing, a plurality of outlets disposed in the housing and operable to receive a plurality of plugs, a sequence control module, where the sequence control module is operable to activate the plurality of outlets in a sequence, and a switch operable to start the activation of the plurality of outlets in the sequence.

Implementations can include any, all or none of the following features. The switch can be a manually operated switch that can be toggled into an open or closed state. The switch can be a foot switch including an elongated projection and a cap disposed on the elongated projection, where the foot switch is operable to be toggled into the open or closed state by the application of a downward force onto the cap. The power strip can also include an on/off switch operable to turn the power strip on or off. The power strip can also include an electrical substrate in electrical communication with the sequence control module, where the foot switch is affixed to the electrical substrate. The sequence control module can also be affixed to the electrical substrate. The foot switch can affix the electrical substrate to the housing at a substantially fixed distance from an interior surface of the housing. The foot switch can also be attached directly to a central portion of the electrical substrate.

According to another feature, the sequence control module is operable to deactivate the plurality of outlets in a sequence. The sequence control module can also be operable to deactivate the plurality of outlets in a sequence that is the reverse of the sequence to activate the plurality of outlets. Additionally, the sequence control module may be operable to deactivate the plurality of outlets in a sequence that is the reverse of the sequence to activate the plurality of outlets, even if only some of the plurality of outlets has been activated. Further, the sequence control module may be operable to activate the plurality of outlets in a sequence including a pre-determined time delay between the activation of at least some of the plurality of outlets.

According to yet another feature, the power strip can include one or more digital encoder knobs that are operatively coupled to the sequence control module, where the digital encoder knobs establish the mode of operation and the length of time of the pre-determined time delay. The sequence control module can also be operable to deactivate the plurality of outlets in a sequence including a second pre-determined time delay between the deactivation of at least some of the plurality of outlets based on the settings of one or more of the digital encoder knobs.

In another aspect, a power strip includes a housing, a plurality of outlets disposed in the housing and operable to receive a plurality of plugs, an on/off switch operable to turn the power strip on or off, and a foot switch including a elongated projection and a cap disposed on the elongated projection, where the foot switch is operable to activate the plurality of outlets, and where the foot switch is operable to be toggled into the open or closed state by the application of a downward force onto the cap.

Implementations can include any, all or none of the following features. The power strip can include an electrical substrate in electrical communication with the sequence control module, where the foot switch is affixed to the electrical substrate. The sequence control module can be affixed to the electrical substrate. The foot switch can also affix the electrical substrate to the housing at a substantially fixed distance from an interior surface of the housing. The foot switch may also be attached directly to a central portion of the electrical substrate.

In a first aspect, one method includes the actions of receiving, at a power strip, power from a power source, and upon receiving a user input at a foot switch or by another input means (e.g., by a signal received by a wireless chip, etc.), applying the received power to a plurality of outlets in a pre-determined activation sequence, with a pre-determined time delay between the activation of each of the plurality of outlets.

Implementations can include any, all or none of the following features. The method can include upon receiving a second user input at a foot switch or by another means (e.g., by a signal received by a wireless chip, etc.), cutting the power to the plurality of outlets in a pre-determined deactivation sequence, with a second pre-determined time delay between the deactivation of each of the plurality of outlets.

Particular embodiments of the subject matter described in this specification can be implemented to realize none, one or more of the following advantages. Sequential powering and depowering of outlets in the power strip can eliminate electrical surges that may otherwise occur when electrical devices are simultaneously powered up and down by conventional power strips.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
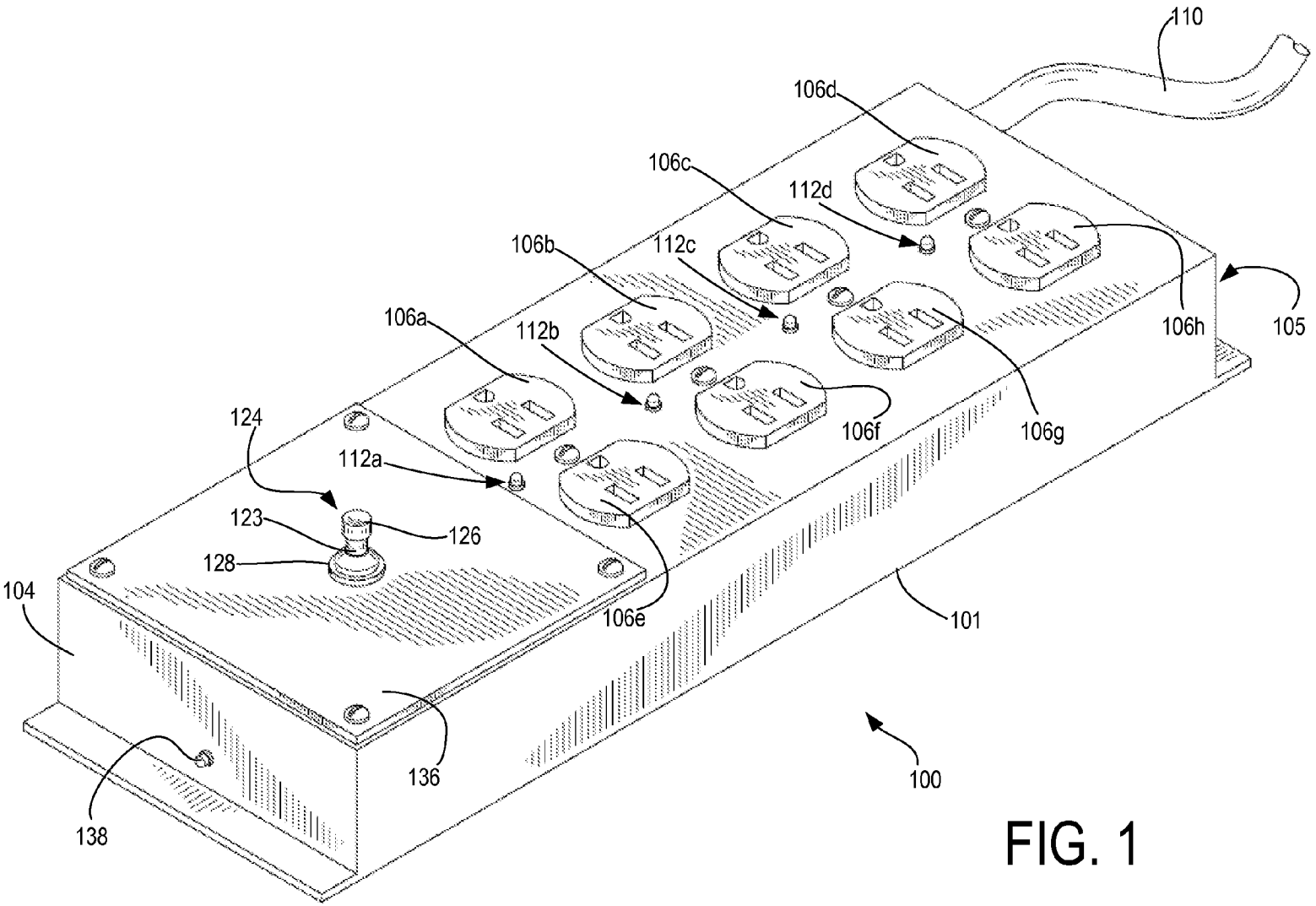
FIG. 1 shows a perspective view of an example power strip.

FIG. 1 shows a perspective view of an example power strip 100. The power strip includes a housing 101 in which power outlets 106*a*, 106*b*, . . . 106*g*, 106*h* (or sockets) are disposed, which can receive plugs from electrical devices. The housing 101 includes a first end 104 and second end 105, and may be made of conventional materials, such as aluminum, steel, plastic, or the like. A power cord 110 supplies A/C power to the power strip 100, such as from a conventional 120V (or 240V) power source. Although illustrated as having conventional 120V power outlets, it will be appreciated that the power strip 100 can include other types of outlets, including one or more outlets that may require different power supplies. For instance, the power strip 100 could include both 120V power outlets and 240V outlets, where the power cord 110 supplies sufficient power to fully power those outlets under typical loads.

In some implementations, the outlets 106*a*, 106*b*, 106*g*, 106*h* of the power strip 100 may be sequentially powered-up and/or powered-down, where one or more pre-determined time delays can occur between the activation or deactivation of each outlet 106*a*, 106*b*, . . . 106*g*, 106*h*. The outlets 106*a*, 106*b*, . . . 106*g*, 106*h* in the example power strip 100 shown in FIG. 1 are paired, such that two outlets (e.g., 106*a*/106*e*, 106*b*/106*f*, 106*c*/106*g*, and 106*d*/106*h*) are powered-up or powered-down together. However, it will be appreciated that in some implementations each outlet 106*a*, 106*b*, . . . 106*g*, 106*h* may also be powered-up or powered-down independently.

Lights 112*a*, 112*b*, 112*c*, 112*d* are disposed in the housing 101 directly adjacent each outlet pair. In some implementations the lights 112*a*, 112*b*, 112*c*, 112*d* may be LED lights, neon lights, and/or conventional lights. In the implementation shown in FIG. 1, each light 112*a*, 112*b*, 112*c*, 112*d* can be powered on when its adjacent outlet pair is powered-up, and may turn off when its adjacent outlet pair is powered-down. This allows visual confirmation of the function of the power-up and power-down sequence of the power strip 100, and confirmation as to which outlets 106*a*, 106*b*, . . . 106*g*, 106*h* are powered-up or powered-down. It will be appreciated that additional lights may be disposed within the housing 101, such as a light for each individual outlet 106*a*, 106*b*, . . . 106*g*, 106*h* if the outlets 106*a*, 106*b*, . . . 106*g*, 106*h* are individually powered-up or down (as opposed to in pairs, as in the example of FIG. 1).

Also disposed on a top surface of the housing 101 is a switch 124. In some implementations the switch 124 is operable to start the activation (i.e., power-up) of the outlets 106*a*, 106*b*, . . . 106*g*, 106*h* in a predetermined sequence. In some implementations, the switch is also operable to start the deactivation (i.e., power-down) of the outlets 106*a*, 106*b*, . . . 106*g*, 106*h* in a pre-determined sequence. The switch 124 can, for example, be a foot switch, such as an electromechanical foot switch including a elongated projection 123 and a cap 126 disposed on the elongated projection. In some implementations the switch 124 may be removably affixed to the housing 101 by a nut 128.

The switch 124 is operable to be toggled into the open or closed state by the application of a downward force onto the cap 126. This permits a user of the power strip 100 to easily initiate the power-up and/or power-down sequences. For instance, the power-up and/or power down sequences may be initiated by the application of pressure on the cap 126 by a foot or the sole of a shoe, boot, or the like. In some implementations, the switch 124 may be removably affixed to a support plate 136 that is secured to a top surface of the housing 101, where the support plate provides extra rigidity to the housing 101 and switch 124, which may increase reliability of the switch 124 even under substantial forces or loads pressing downward on the cap 126.

The sequential activation (i.e., power-up) and deactivation (i.e., power-down) of the outlets 106*a*, 106*b*, . . . 106*g*, 106*h* initiated by the switch 124 can occur using a pre-determined time delay between the activation and/or deactivation of each of the plurality of outlets. For instance, in the example power strip 100, after the switch 124 is toggled into a closed state, a pre-determined time delay may occur before the first outlet pair 106*a*/106*e* is powered-up, and again after the first outlet pair 106*a*/106*e* is powered-up but before the second outlet pair 106*b*/106*f* is powered, and so forth, until each of the outlet pairs are powered. In some implementations a similar pre-determined time delay may occur during power-down of the outlets, although the pre-determined time delay for the sequential activation may be different than the pre-determined time delay for the sequential deactivation. For instance, there may be a 2 second delay between the power-up of each outlet, and a 1 second (or 0 second) delay between the power-down of each outlet.

According to an implementation, a user can control the length of each pre-determined time delay using a timer input 138 disposed in the housing 101. Although only one timer input 138 is illustrated in FIG. 1, which may control both the time of the pre-determined power-up and power-down time delays, separate timer inputs may be disposed in the housing 101 and adjusted by the user to control the time of the pre-determined power-up and power-down time delays. According to an implementation, the timer input 138 can include a potentiometer that is rotatable by a user to adjust the time delay. According to another implementation, the timer input 138 can include a rotary binary coded dip switch that is rotatable by a user to adjust the time delay.

For instance, a user can turn the potentiometer or dip switch to adjust a time delay from 0 seconds to 15 seconds. The delay may be incremented in seconds, or may be incremented nearly infinitely depending on the user's adjustment of the timer input 138. In some implementations the timer input 138 can include a visual indicator, such as a line, indentation, arrow, or the like, that allows a user to view how the timer input 138 is set. Additionally, in some implementations, the housing 101 can include markings adjacent the visual indicator of the timer input 138. In some implementations the marking may represent the time delay, in seconds, between the power-up and/or power-down of the outlets 106*a*, 106*b*, . . . 106*g*, 106*h*. For instance, the housing 101 can include numbers from 1-15 surrounding the timer input 138, where the timer input 138 can be rotated and set to a marked position "0" for no time delay (i.e., all outlets 106*a*, 106*b*, . . . 106*g*, 106*h* are powered up and/or powered down at together), or rotated and set to a marked position "15" for a 15 second time delay in the power-up or power-down of the outlets 106*a*, 106*b*, . . . 106*g*, 106*h*. It will be appreciated that the user may adjust the time delay to virtually any length of time, and that the timer input 138 may provide delays much greater than 15 seconds, such as 1 minute, 10 minutes, an hour, or the like.

Figure 2:
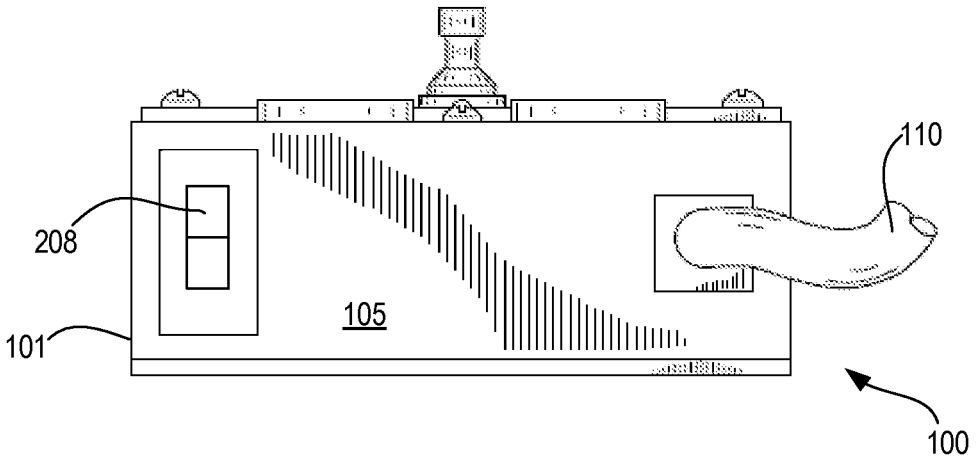
FIG. 2 shows an end view of the example power strip of FIG. 1.

FIG. 2 shows an end view of the second end 105 of the example power strip 100 of FIG. 1. The second end 105 includes an on/off switch 208, such a conventional toggle switch, disposed in the housing 101. The on/off switch 208 receives a power supply from the power cord 110 and can permit or prevent power from being supplied to the components within the power strip 100. Although not illustrated, in some implementations one or more lights may be disposed in the housing 101, such as in the first end 104 of the housing 101, that indicate when the power strip 100 is on. The on/off switch 208 may also include a light indicating whether the on/off switch 208 is in the on or off position. It should be appreciated that the outlets 106*a*, 106*b*, . . . 106*g*, 106*h* are not necessarily powered-up when the power strip 100 is on; rather, both the on/off switch 208 and switch 124 have to be toggled "on" prior to power-up the outlets 106*a*, 106*b*, . . . 106*g*, 106*h*. Conversely, toggling the on/off switch 208 to "off" prevents use of the power strip 100. In some implementations, the on/off switch 208 only provides power to a sequence control module, described in detail with respect to FIG. 5, and it does not power-up, or activate, the outlets 106*a*, 106*b*, . . . 106*g*, 106*h*.

Figure 3:
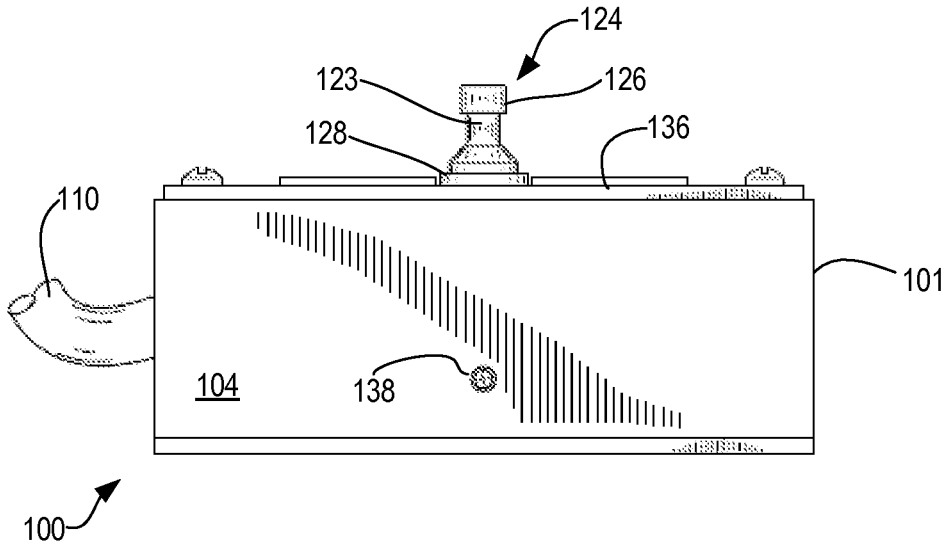
FIG. 3 shows an end view of another end of the example power strip of FIG. 1.

FIG. 3 shows an end view of the first end 104 of the example power strip 100 of FIG. 1. FIG. 3 shows another view of the switch 124 having, in some implementations, an elongated projection 123 and a cap 126 disposed on the elongated projection, where the switch 124 is removably affixed by a nut 128 to a support plate 136 secured to a top surface of the housing 101. In some implementations, the timer input 138 is disposed in the housing 101 on the first end 104, and may be rotated by a user.

In some implementations, the switch 124 defaults to an open state (i.e., or "off" position) when the power strip 100 is turned on, which happens when the strip 100 is powered by a power supply from the power cord 110 and when an on/off switch 208 is in an "on" position. In some implementations, the foot switch 124 can default to an "off" position when the on/off switch 208 of the power strip 100 is switched to an "on" position, regardless of the actual mechanical position of the switch 124.

Figure 4:
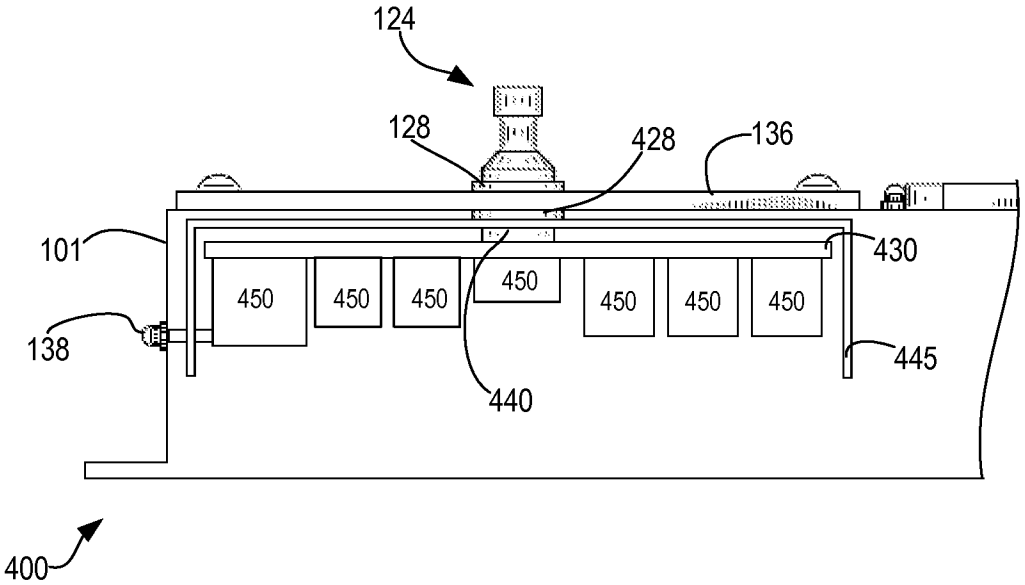
FIG. 4 shows a partial cross-section view of a switch and its connection to an electrical assembly of the example power strip of FIG. 1.

FIG. 4 shows a partial cross-section view 400 of the switch 124 and its connection to an electrical assembly of the example power strip 100 of FIG. 1. In some implementations, the switch 124 is affixed to an electrical substrate 430 carrying electrical components 450 (collectively, the substrate 430 and components 450 make up the electrical assembly) that control the operation of the power strip 100, including the sequence control module. For instance, the electrical substrate 430 can include a printed circuit board (such as FR-4) or similar rigid or flexible substrate to provide interconnections between components to form an electric circuit.

As shown in FIG. 4, in some implementations the switch 124 is attached directly to a central portion of the electrical substrate 430 at the bottom 440 of the switch 124, which can include leads that attach the switch 124 to the substrate 430. Additionally, in some implementations, the switch 124 affixes the electrical substrate 430 to the housing 101 at a substantially fixed distance from an interior surface of the housing 101. The switch 124 can be attached to a support plate 136 secured to a top surface of the housing 101 by a nut 128. In some implementations, another nut 428 can secure the switch 124 to a shield 445 that surrounds the electrical assembly, although it will be appreciated that the shield is optional. Where a shield 445 is used, the shield 445 may include one or more holes through which some electrical components may pass, such as a time input 138.

It will be appreciated that connecting the switch 124 to the electrical substrate 430 in a configuration that permits the switch 124 to affix the electrical assembly to the housing 101 results in a durable structure that increases the reliability of the switch 124, even under substantial forces or loads pressing downward on the cap 126.

Figure 5:
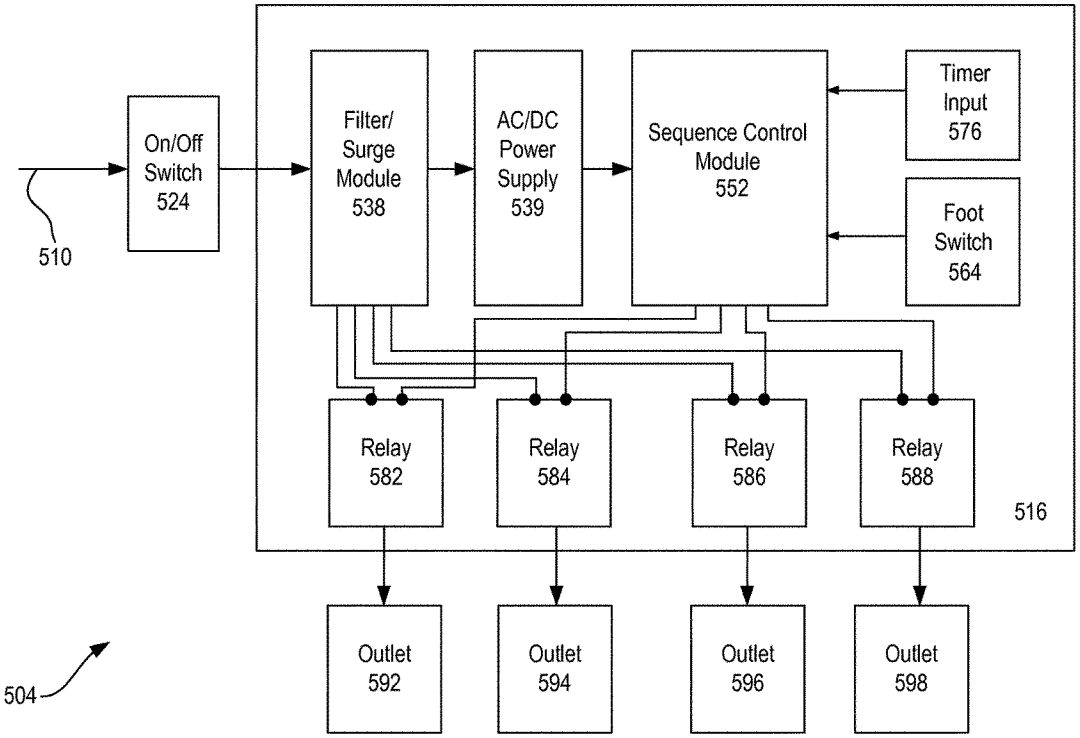
FIG. 5 is a block diagram of an example implementation of a power strip.

FIG. 5 is a block diagram 504 of an example implementation of the power strip. In some implementations, an on/off switch 524 receives AC power 510 from an external power source, and can be toggled to either permit or prevent power from being supplied to an electrical assembly 516 of the power strip 100. The AC power can be received at a filter/surge module 538 that is operable to provide power filtering and surge protection to the power strip. As illustrated, in some implementations the filter/surge module 538 can be electrically connected to relays 582, 584, 586, 588 and to an AC/DC power supply 539. In some implementations, the AC/DC power supply 539 receives filtered power from the filter/surge module 538 and provides a DC power source to the sequence control module 552.

The sequence control module 552 module is operable to activate the plurality of outlets 592, 594, 596, 598 in a sequence. In some implementations, the sequence control module 552 receives the timer input 576, which can include one or more timer inputs that establish a pre-determined time delay between the activation and/or deactivation of each of the outlets 592, 594, 596, 598. For instance, the timer input 576 can include a user-adjustable potentiometer to allow a user to set the pre-determined time delay between both the activation and deactivation of the outlets 592, 594, 596, 598. According to another implementation, the timer input 576 can include two user-adjustable potentiometers to allow a user to set a first pre-determined time delay for the activation (i.e., power-up) of the outlets 592, 594, 596, 598, and a second time delay for the deactivation (i.e., power-down) of the outlets 592, 594, 596, 598.

The sequence control module 552 also receives input from a foot switch 564, such as the foot switch 124. When the foot switch 564 is toggled on, the sequence control module 552 can sequentially transmit signals to the relays 582, 584, 586, 588 in a predetermined sequence to control the power-up and power-down of the outlets 592, 594, 596, 598. According to some implementations, each relay is associated with a respective outlet (or pair of outlets, such as in the example power strip 100) such that power to each outlet is supplied through the respective relay associated with that outlet. When a particular outlet is to be powered-up according to the predetermined sequence, the sequence control module 552 transmits a signal energizing the relay associated with that outlet, permitting power to flow from the filter/surge module 538 to the outlet. Similarly, when a particular outlet is to be powered-down according to the predetermined sequence, the sequence control module 552 de-energizes the relay associated with that outlet, preventing power from flowing from the filter/surge module 538 to the outlet.

In some implementations, the sequence control module 552 can deactivate, or power-down, the outlets 592, 594, 596, 598 in a sequence that is the reverse of the sequence to activate, or power-up, the outlets 592, 594, 596, 598. Additionally, the sequence control module 552 may be operable to deactivate the outlets 592, 594, 596, 598 in a sequence that is the reverse of the sequence to activate the outlets 592, 594, 596, 598, even if only some of the plurality of outlets have been activated. This may occur, for instance, if the foot switch 564 is toggled rapidly from the "on" to the "off" position before the activation sequence is completed.

To affect the sequence control, the sequence control module 552 can include, for instance, a microcontroller, such as a programmable flash device. The processes and logic flows of the sequence control module 552 can also or alternatively be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Figure 6:
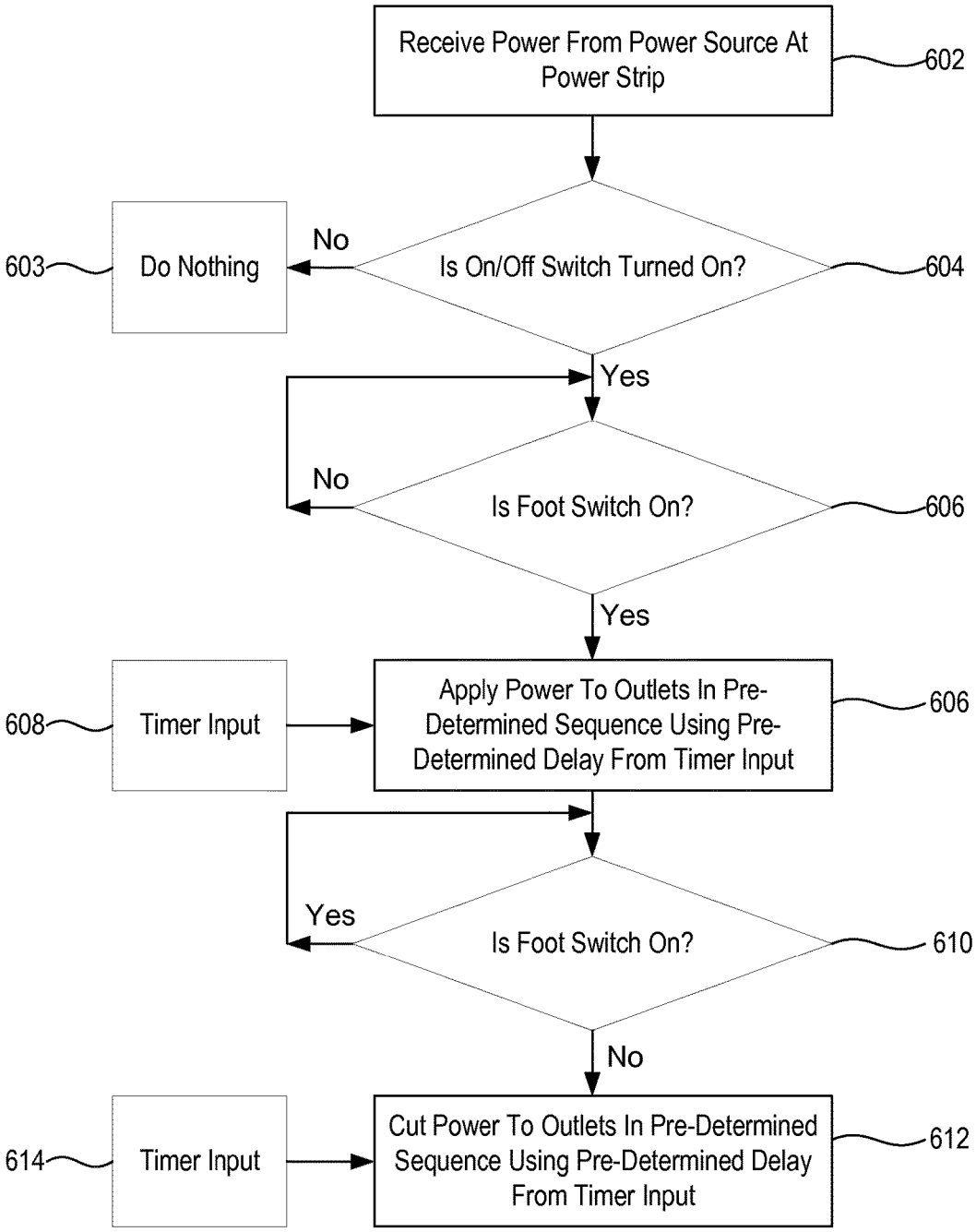
FIG. 6 is a flow chart of an example operation of a power strip.

FIG. 6 is a flow chart of an example operation of a power strip of the present invention. Power is received from a power source at a power strip of the present invention (602). According to some implementations, an on/off switch is either in the "on" or "off" position (604). If the on/off switch is "off", nothing is done (603) because the power supply is inoperable. According to some implementations, an foot switch is either in an "on" or "off" state (606). If the on/off switch is "on", and the foot switch is "off" then nothing happens until the foot switch is toggled to the "on" position. If the on/off switch is "on", and the foot switch state is changed to "on", then power is applied to outlets in a pre-determined sequence using a pre-determined time delay (606) set provided by a timer input (608). For instance, a user can establish the timer input by adjusting a potentiometer on the power strip. If the foot switch remains in the "on" state, then nothing happens, though power remains in the outlets that were previously activated. If the foot switch state is changed to "off", then power is cut to outlets in a pre-determined sequence using a pre-determined time delay (612) set provided by a timer input (614). For instance, a user can establish the timer input by adjusting a potentiometer on the power strip, and this timer input may be the same or different from the timer input (608) that determined the delay in applying power to the outlets (606).

Figure 7:
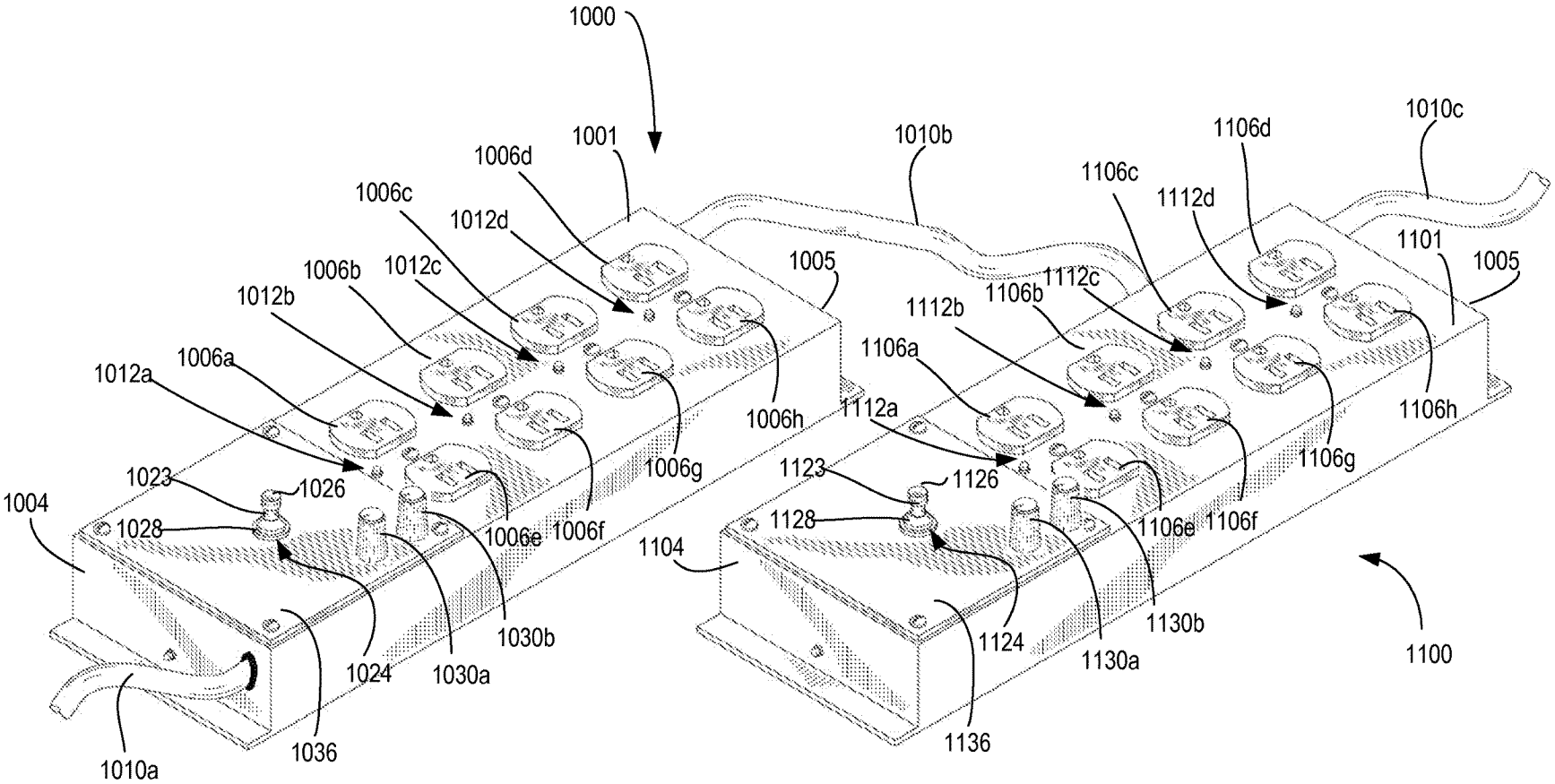
FIG. 7 is a perspective view of an example power strip shown connected in series with another power strip.

FIG. 7 shows a perspective view of example power strips 1000 and 1100 connected in series. For purposes of brevity and ease of understanding, the following description will be focused on the first power strip 1000 since the two power strips 1000 and 1100 are similar. Therefore, the following discussion with respect to power strip 1000 applies equally to power strip 1100. Power strip 1000 includes a housing 1001 in which power outlets 1006*a*, 1006*b*, . . . 1006*g*, 1006*h* (or sockets) are disposed, which can receive plugs from electrical devices. The housing 1001 includes a first end 1004 and second end 1005, and may be made of conventional materials, such as aluminum, steel, plastic, or the like. A power cord 1010*a* supplies A/C power to the power strip 1000, such as from a conventional 120V (or 240V) power source. Although illustrated as having conventional 120V power outlets, it will be appreciated that the power strip 1000 can include other types of outlets, including one or more outlets that may require different power supplies. For instance, the power strip 1000 could include both 120V power outlets and 240V outlets, where the power cord 1010 supplies sufficient power to fully power those outlets under typical loads.

In some implementations, the outlets 1006*a*, 1006*b*, 1006*g*, 1006*h* of the power strip 1000 may be sequentially powered-up and/or powered-down, where one or more pre-determined time delays can occur between the activation or deactivation of each outlet 1006*a*, 1006*b*, . . . 1006*g*, 1006*h*. The outlets 1006*a*, 1006*b*, . . . 1006*g*, 1006*h* in the example power strip 1000 shown in FIG. 7 are paired, such that two outlets (e.g., 1006*a*/1006*e*, 1006*b*/1006*f*, 1006*c*/1006*g*, and 1006*d*/1006*h*) are powered-up or powered-down together. However, it will be appreciated that in some implementations each outlet 1006*a*, 1006*b*, . . . 1006*g*, 1006*h* may also be powered-up or powered-down independently.

Lights 1012*a*, 1012*b*, 1012*c*, 1012*d* are disposed in the housing 1001 directly adjacent each outlet pair. In some implementations the lights 1012*a*, 1012*b*, 1012*c*, 1012*d* may be LED lights, neon lights, and/or conventional lights. In the implementation shown in FIG. 7, each light 1012*a*, 1012*b*, 1012*c*, 1012*d* can be powered on when its adjacent outlet pair is powered-up, and may turn off when its adjacent outlet pair is powered-down. This allows visual confirmation of the function of the power-up and power-down sequence of the power strip 1000, and confirmation as to which outlets 1006*a*, 1006*b*, . . . 1006*g*, 1006*h* are powered-up or powered-down. It will be appreciated that additional lights may be disposed within the housing 1001, such as a light for each individual outlet 1006*a*, 1006*b*, . . . 1006*g*, 1006*h* if the outlets 1006*a*, 1006*b*, . . . 1006*g*, 1006*h* are individually powered-up or down (as opposed to in pairs, as in the example of FIG. 7).

Also disposed on a top surface of the housing 1001 is a switch 1024. In some implementations the switch 1024 is operable to start the activation (i.e., power-up) of the outlets 1006*a*, 1006*b*, . . . 1006*g*, 1006*h* in a predetermined sequence. In some implementations, the switch is also operable to start the deactivation (i.e., power-down) of the outlets 1006*a*, 1006*b*, . . . 1006*g*, 1006*h* in a pre-determined sequence. The switch 1024 can, for example, be a foot switch, such as an electromechanical foot switch including an elongated projection 1023 and a cap 1026 disposed on the elongated projection. In some implementations the switch 1024 may be removably affixed to the housing 1001 by a nut 1028.

The switch 1024 is operable to be toggled into the open or closed state by the application of a downward force onto the cap 1026. This permits a user of the power strip 1000 to easily initiate the power-up and/or power-down sequences. For instance, the power-up and/or power down sequences may be initiated by the application of pressure on the cap 1026 by a foot or the sole of a shoe, boot, or the like. In some implementations, the switch 1024 may be removably affixed to a support plate 1036 that is secured to a top surface of the housing 1001, where the support plate provides extra rigidity to the housing 1001 and switch 1024, which may increase reliability of the switch 1024 even under substantial forces or loads pressing downward on the cap 1026.

The sequential activation (i.e., power-up) and deactivation (i.e., power-down) of the outlets 1006*a*, 1006*b*, . . . 1006*g*, 1006*h* initiated by the switch 1024 can occur using a pre-determined time delay between the activation and/or deactivation of each of the plurality of outlets similar to that described for the power strip of FIG. 1. In other embodiments, the user may set one or both digital encoder switches 1030*a* and 1030*b* to change the operation between one of various modes. For example, in a standard mode, the user may dial in the time delay desired for the on delay sequence and the off delay sequence from one to fifteen seconds using the two digital encoder switches 1030*a* and 1030*b*. Once the digital encoders are set, the user may activate or deactivate the power strip by depressing the button 1026 with their foot. In an instant on mode, the user may set the first digital encoder switch 1030*a* for an "on" delay to a zero second delay setting to select instant on mode. The user may also independently set the second digital encoder switch 1030*b* to any desired off delay from one-fifteen seconds. The off delay setting will determine the delay sequence for both on and off delay. Thus, when the power strip is activated or deactivated using the foot switch 1026, the unit will immediately turn on sequentially or turn off sequentially. In an always on mode, the user may set the second digital encoder switch 1030*b* to an "off" delay of zero seconds to select the "always on mode". In the "always on mode", the first digital encoder switch 1030*a* may be set to an "on" delay from one-fifteen seconds. The setting of the first digital encoder 1030*a* will determine the delay sequence for both on and off delay. Thus, when power is applied to the strip 1000, the first outlet pair 1006*a* and 1006*e* will immediately turn on and will stay on until power is removed. The remaining three outlet pairs 1006*b*/1006*f*, 1006*c*/1006*g* and 1006*d*/1006*h* turn on and off sequentially when the user depresses the push button switch 1026.

Still referring to FIG. 7, power strip 1000 may be daisy changed to a second power strip by either plugging the power cord 1010*c* of power strip 1100 into one of the last outlets of outlet pair 1006*d*/1006*h* or by using a direct power connector such as a Neutrik Powercon connector, manufactured by Neutrik AG of Liechtenstein, so that a power cord 1010*b* from the second power strip 1100 can be directly connected to the first power strip 1000. In this way, the direct power connector can be wired internally to the outlet pair 1006*d*/1006*h* so that once the last outlet pair 1006*d*/1006*h* power on, this activates the second power strip 1100 (in place of depressing foot switch 1126) so that the outlets on power strip 1100 continue to power on in sequence in accordance with the settings of digital encoder switches 1130*a* and 1130*b*. It should be understood from reference to this disclosure that any number of power strips may be daisy chained so that their respective outlet pairs may power on sequentially.

According to various embodiments, a main light 1038 on power strip 1000 and 1138 on power strip 1100 may be powered on when the user plugs the power strip 1000 into a power outlet or daisy chains a second power outlet 1100 to a first power outlet 1000. In this way, the user can get a visual notification that the power strip is receiving power to the processor contained within the power strip.

Figure 8:
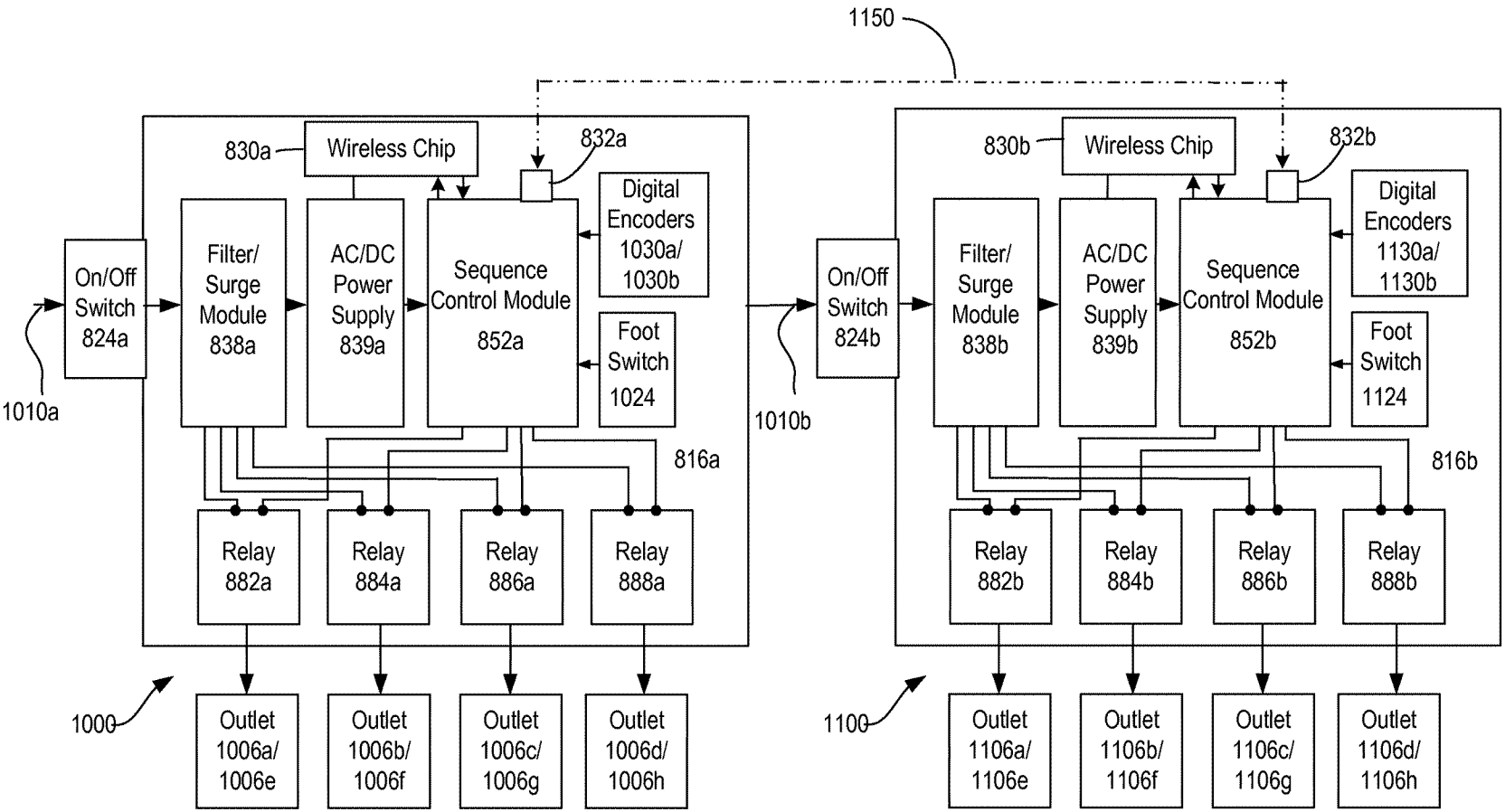
FIG. 8 is a block diagram of an example implementation of another embodiment of a power strip.

Referring to FIG. 8, a block diagram of an example implementation of the power strip 1000/1100 of FIG. 7 is illustrated. In some implementations, an on/off switch 824*a* receives AC power through a power cord 1010*a* from an external power source, and can be toggled to either permit or prevent power from being supplied to an electrical assembly 816*a* of the power strip 1000. The AC power can be received at a filter/surge module 838*a* that is operable to provide power filtering and surge protection to the power strip. As illustrated, in some implementations the filter/surge module 838*a* can be electrically connected to relays 882*a*, 884*a*, 886*a*, 888*a* and to an AC/DC power supply 839*a*. In some implementations, the AC/DC power supply 839*a* receives filtered power from the filter/surge module 838*a* and provides a DC power source to the sequence control module 852*a*.

The sequence control module 852*a* is operable to activate the plurality of outlets 1006*a*/1006*e*, 1006*b*/1006*f*, 1006*c*/1006*g*, 1006*d*/1006*h* in a sequence. In some implementations, the sequence control module 852 receives the delay mode/settings from the digital encoders 1030*a*/1030*b*, which can include one or more timer inputs that establish a pre-determined program and timer delay between the activation and/or deactivation of each of the outlets/pairs 1006*a*/1006*e*, 1006*b*/1006*f*, 1006*c*/1006*g*, 1006*d*/1006*h*. For instance, the digital encoders 1030*a*/1030*b* can include two adjustment knobs to allow a user to set the time delay for both the activation and deactivation of the outlet pairs 1006*a*/1006*e*, 1006*b*/1006*f*, 1006*c*/1006*g*, 1006*d*/1006*h*. Additionally, the user can also place the power strip into one or more modes that may include (1) a "standard" mode where the on and off sequence delay is entered, (2) an "instant on" mode where each of the outlet pairs turn on sequentially based on a set time delay, and (3) an "always on" mode where the first outlet pair 1006*a*/1006*e* is always on and the remaining outlet pairs activate and deactivate based on a time delay that is entered by the user.

According to another implementation, the digital encoders 1030*a*/1030*b* can include multiple adjustment increments to allow a user to set a first pre-determined time delay for the activation (i.e., power-up) of the outlets 1006*a*/1006*e*, 1006*b*/1006*f*, 1006*c*/1006*g*, 1006*d*/1006*h*, and a second time delay for the deactivation (i.e., power-down) of the outlets 1006*a*/1006*e*, 1006*b*/1006*f*, 1006*c*/1006*g*, 1006*d*/1006*h*. In various embodiments, each digital encoder has 16 inputs starting with zero seconds to fifteen seconds. In other embodiments, each digital encoder may have any number of inputs (e.g., 15, 30, 60, etc.). In some of these embodiments, each increment may correspond to one second. In other embodiment, each increment may correspond to a portion of a second or multiple seconds depending on the design and use of the power strip.

The sequence control module 852*a* also receives input from a foot switch, such as the foot switch 1024. When the foot switch 1024 is toggled on, the sequence control module 852*a* can sequentially transmit signals to the relays 882*a*, 884*a*, 886*a*, 888*a* in a predetermined sequence to control the power-up and power-down of the outlets 1006*a*/1006*e*, 1006*b*/1006*f*, 1006*c*/1006*g*, 1006*d*/1006*h*. According to some implementations, each relay is associated with a respective outlet (or pair of outlets) such that power to each outlet is supplied through the respective relay associated with that outlet. When a particular outlet is to be powered-up according to the predetermined sequence, the sequence control module 852*a* transmits a signal energizing the relay associated with that outlet, permitting power to flow from the filter/surge module 838*a* to the outlet. Similarly, when a particular outlet is to be powered-down according to the predetermined sequence, the sequence control module 852*a* de-energizes the relay associated with that outlet, preventing power from flowing from the filter/surge module 838*a* to the outlet.

In some implementations, the sequence control module 852*a* can deactivate, or power-down, the outlets 1006*a*/1006*e*, 1006*b*/1006*f*, 1006*c*/1006*g*, 1006*d*/1006*h* in a sequence that is the reverse of the sequence to activate, or power-up, the outlets 1006*a*/1006*e*, 1006*b*/1006*f*, 1006*c*/1006*g*, 1006*d*/1006*h*. Additionally, the sequence control module 852*a* may be operable to deactivate the outlets 1006*a*/1006*e*, 1006*b*/1006*f*, 1006*c*/1006*g*, 1006*d*/1006*h* in a sequence that is the reverse of the sequence to activate the outlets 1006*a*/1006*e*, 1006*b*/1006*f*, 1006*c*/1006*g*, 1006*d*/1006*h*, even if only some of the plurality of outlets have been activated. This may occur, for instance, if the foot switch 1024 is toggled rapidly from the "on" to the "off" position before the activation sequence is completed.

In addition to manually setting the activation and deactivation mode and time delay via the foot switch 1024, the power strip 1000 may contain a wireless communication chip that transmits and receives control signals to and from a wireless computing device (e.g., a computer, laptop, tablet, handheld computing device, smart phone, etc.). In various embodiments, the wireless chip may be a Bluetooth communication chip, a Wi-Fi communication chip, a near field communication chip or any other wireless communication chip that allows the user to remotely program the operation of the power strip. Moreover, in various embodiments, each power strip 1000 and 1100 may include respective wireless communication chips 830*a* and 830*b* that allows each power strip to communicate with the remote computing device and/or with each other. Thus, in some embodiments, the activation sequence of a first power strip 1000 and a second power strip 1100 may be carried out by signals transmitted from one sequence control module 852*a* in power strip 1000 to a second sequence control module 852*b* in a second power strip 1100.

In various embodiments, the wireless chip 830*a* sends signals to and receives signals from the sequence control module 852*a* to allow the sequence control module 852*a* to be programmed by the user. In some embodiments, the wireless chip may also be operatively coupled to the AC/DC power supply 839*a* in order to power the wireless chip 830*a*. In various embodiments, the power strip 852*a* may include in addition to, or instead of the wireless chip 830*a* a port 832*a* that allows the first power strip 1000 to be connected to the second power strip 1100 via a control cable 1150. The port 832*a* may be a USB port or any other suitable port that allows control signals to be delivered to, or from, the sequence control module 852*a*. In various embodiments, firmware or software running on the sequence control module 852*a* may be updated wireless via the wireless chip 830*a* or by a wired connection through the port 832*a*. Thus, updated programming software or firmware can be loaded at any time to improve the operation of the power strip 1000.

To affect the sequence control, the sequence control module 852*a* can include, for instance, a microcontroller, such as a programmable flash device. The processes and logic flows of the sequence control module 852*a* can also or alternatively be performed by one or more programmable processors executing one or more computer programs to perform functions by operating on input data and generating output data. The processes and logic flows can also be performed by, and apparatus can also be implemented as, special purpose logic circuitry, e.g., an FPGA (field programmable gate array) or an ASIC (application-specific integrated circuit).

While FIGS. 7 and 8 show two power strips 1000 and 1100 daisy chained together, it should be understood from reference to this disclosure that any number of power strips may be daisy chained together and controlled so that the outlets on each power strip activate or deactivate in a particular sequence with particular time delays. Moreover, depending on whether the power strip is operating in a "standard" mode, "instant on" mode or "always on" mode, certain outlets may be on all the time. In the embodiments shown in FIGS. 7 and 8, outlets 1006*a*/1006*e*, 1006*b*/1006*f*, 1006*c*/1006*g*, 1006*d*/1006*h* on power strip 1000 may power on with a first particular delay time between each pair of outlets, and outlets 1106*a*/1106*e*, 1106*b*/1106*f*, 1106*c*/1106*g*, 1106*d*/1106*h* on power strip 1100 may activate in series with the same particular delay time sequence once the pairs of outlets on power strip 1000 are all activated. In other embodiments, power strip 1000 and power strip 1100 may power on the pairs of outlets simultaneously with the same particular delay time sequence. For example, outlets 1006*a*/1006*e* and outlets 1106*a*/1106*e* may power on at the same time. Next, five seconds later outlets 1006*b*/1006*f* and outlets 1106*b*/1106*f* may simultaneously power on. The remaining outlets may power on similar to the first two pairs. In still other embodiments, power strip 1000 and 1100 may be programmed to turn on certain pairs of outlets while turning off other pairs of outlets depending on the use of the power strips.

For example, in particular embodiments, power strip 1000 may activate each pair of outlets 5 seconds after the previous pair of outlets is activated. Once all of the outlet pairs are activated on power strip 1000, the first pair of outlets on power strip 1100 will activate 5 seconds after the last pair of outlets 1006*d*/1006*h* are activated. The remaining outlet pairs of power strip 1100 will continue until all outlet pairs are activated. In various embodiments, the digital encoders 1030*a*/1030*b* may be set so that the outlet pairs on power strip 1000 activate 5 minutes apart from one another. In some embodiments, the digital encoders 1130*a*/1130*b* on power strip 1100 may be set so that each of the outlet pairs on power strip 1100 activate 8 seconds apart from one another. It should be understood that that through programming of the sequence control module 852*a* and 852*b*, the outlets on each power strip may be activated or deactivated in any order with any preset time delay between each outlet.

Programing of the predetermined time delay for activating and/or deactivating may be accomplished using the digital encoders 1030*a*/1030*b* and 1130*a*/1130*b*, by a wired connection using ports 832*a* and 832*a*, or by a wireless connection using wireless chip 830*a* and 830*b*. Moreover, triggering the activation sequence may be accomplished by manually depressing the foot switch 1024 and/or 1124, by a control signal provided via port 832*a*/832*b* or via a wireless control signal sent via wireless chip 830*a*/830*b*. Additionally, when power strips are daisy chained together, the second power strip may be placed into a mode so that when the first power strip activates its last outlet, the first power strip may also provide electricity via the coupling cable 1010*b* so that the receipt of electricity over cable 1010*b* also provides the second power strip with the needed control signal to cause the second power strip to begin to activate its outlets in accordance with the programmed activation sequence. Similar to activation, the first and second power strips may deactivate the first and second plurality of outlets sequentially according to the same activation sequence or in accordance with any preprogrammed deactivation sequence.

While this specification contains many specifics, these should not be construed as limitations on the scope of what being claims or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understand as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular embodiments of the subject matter described in this specification have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

The invention claimed is:

1. A power strip, comprising:

a. a first power strip comprising:

i. a first housing;

ii. a first plurality of outlets disposed in the first housing and operable to each receive a plug;

iii. a first controller operable to activate each one of the plurality of outlets in a first sequence based on input received by the first controller; and iv. a control signal source selected from a group consisting of:

a first plurality of digital encoders;

a first wireless chip that is operatively coupled to the first controller and configured to receive input commands from and transmit data to a remote computing device;

a first wired port that is operatively coupled to the first controller; and a first foot switch; and b. a second power strip comprising:

i. a second housing;

ii. a second plurality of outlets disposed in the second housing and operable to each receive a plug;

iii. a second control module operable to activate each one of the plurality of outlets in a second sequence based on input received by the second controller; and iv. one or more second control signal sources selected from a group consisting of:

a second plurality of digital encoders;

a second wireless chip that is operatively coupled to the second controller and configured to receive input commands from and transmit data to the remote computing device; and a second wired port that is operatively coupled to the second controller; and a second foot switch, wherein the first controller is operatively coupled to the second controller, the first controller is operable to activate the first plurality of outlets in a first sequence, and the second controller is operable to activate the second plurality of outlets in a second sequence based at least in part on the first sequence.

2. The power strip of claim 1, wherein a. the one or more first control signal sources further comprise a first plurality of digital encoders operatively coupled to the first controller, and b. the first plurality of digital encoders are moveable between:

a first position that corresponds to a standard mode in which each outlet in the first plurality of outlets activates sequentially after the passage of a predetermined time delay once the first controller receives a first signal to begin to sequence the first plurality of outlets;

a second position that corresponds to an instant on mode in which when the first power strip is turned on the first plurality of outlets will automatically activate sequentially after the passage of a predetermined time delay; and a third position that corresponds to an always on mode in which one of the first plurality of outlets is always on and the remaining first plurality of outlets activates sequentially after the passage of a predetermined time delay once the first controller receives the first signal to begin to sequence the first plurality of outlets.

3. The power strip of claim 2, wherein a. the one or more second control signal sources further comprise a second plurality of digital encoders operatively coupled to the second controller, and b. the second plurality of digital encoders are moveable between:

a first position that corresponds to a standard mode in which each outlet in the second plurality of outlets activates sequentially after the passage of a predetermined time delay once the second controller receives a second signal to begin to sequence the second plurality of outlets;

a second position that corresponds to an instant on mode in which when the first power strip is turned on the second plurality of outlets will automatically activate sequentially after the passage of a predetermined time delay; and a third position that corresponds to an always on mode in which one of the second plurality of outlets is always on and the remaining second plurality of outlets activates sequentially after the passage of a predetermined time delay once the second controller receives the second signal to begin to sequence the second plurality of outlets.

4. The power strip of claim 2, wherein the first signal is generated at least in part by a first foot switch that is operatively coupled to the first controller, wherein the first foot switch comprises a first elongated projection and a first cap disposed on the first elongated projection, wherein the first foot switch is operable to be toggled into the open or closed state by the application of a downward force onto the first cap.

5. The power strip of claim 3, wherein the second signal is generated at least in part by a second foot switch that is operatively coupled to the second controller, wherein the second foot switch comprises a second elongated projection and a second cap disposed on the second elongated projection, wherein the second foot switch is operable to be toggled into the open or closed state by the application of a downward force onto the second cap.

6. The power strip of claim 3, wherein the second signal is based at least in part on the first signal.

7. The power strip of claim 3, further comprising:

a. a first wireless chip mounted in the first housing and operatively coupled to the first controller; and b. a second wireless chip mounted in the second housing and operatively coupled to the second controller, wherein the first wireless chip and the second wireless chip are wirelessly coupled to a remote computing device, the first wireless chip is operatively coupled to the second wireless chip, and the remote computing device transmits the first signal and the second signal wirelessly to the first controller and the second controller.

8. The power strip of claim 7, wherein the first wireless chip and the second wireless chip are Bluetooth chips.

9. A method of connecting a plurality of power strips to one another, the method comprising:

a. providing a first power strip comprising:

i. a first housing;

ii. a first plurality of outlets disposed in the first housing and operable to each receive a plug;

iii. a first controller operable to activate each one of the first plurality of outlets in a first sequence based on a first control signal received by the first controller;

iv. a first control signal source that is configured to provide the first control signal to the first controller;

b. providing a second power strip comprising:

v. a second housing;

vi. a second plurality of outlets disposed in the second housing and operable to each receive a plug;

vii. a second controller operable to activate each one of the second plurality of outlets in a second sequence based on a second control signal received by the second controller;

viii. a second control signal source that is configured to provide the second control signal to the second controller;

c. programming the first controller to activate the first plurality of outlets based at least in part on a first sequence that comprises a first time delay;

d. programming the second controller to activate the second plurality of outlets based at least in part on a second sequence that comprises a second time delay;

e. operatively coupling the second controller to the first power strip;

f. activating the first controller to turn on the first plurality of outlets based at least in part on the first sequence and the first time delay; and g. activating the second controller to turn on the second plurality of outlets based at least in part on the second sequence, the second time delay and the first sequence.

10. The method of claim 9, wherein activating the first controller further comprises receiving an activation signal at least partially based upon manual activation of a first foot switch.

11. The method of claim 9, wherein activating the first controller further comprises wirelessly receiving an activation signal from a mobile computing device.

12. The method of claim 9, wherein the first time delay and the second time delay are equal.

13. A power strip, comprising:

a. a first power strip comprising:

i. a first housing;

ii. a first plurality of outlets disposed in the first housing and configured to each receive a plug;

iii. a first controller mounted in the first housing and configured to activate each one of the plurality of outlets in a first sequence at least partially based on a first input signal received by the first controller;

iv. at least one digital encoder that is mounted to the housing and that is operatively coupled to the first controller; and b. a second power strip comprising:

i. a second housing;

ii. a second plurality of outlets disposed in the second housing and configured to each receive a plug;

iii. a second control module mounted in the first housing and configured to activate each one of the plurality of outlets in a second sequence at least partially based on a second input signal received by the second controller; and iv. at least one digital encoder that is mounted to the housing and that is operatively coupled to the second controller;

wherein the first controller is operatively coupled to the second controller, the first power strip at least one digital encoder is configured to generate the first input signal, the second power strip at least one digital encoder is configured to generate the second input signal, when the first controller is triggered to activate the first plurality of outlets, each outlet is activated at least partially based on the first sequence; and when the last outlet of the first plurality of outlets is activated, a signal is sent from the first power strip to the second power strip causing the second power strip to begin activating the second plurality of outlets at least partially based on the second sequence.

14. The power strip of claim 13, wherein:

a. the first sequence comprises a first activation order for each one of the first plurality of outlets and a first time delay; and b. the second sequence comprises a second activation order for each one of the second plurality of outlets and a second time delay.

15. The power strip of claim 14, wherein the first time delay and the second time delay are the same.

16. The power strip of claim 13, wherein the first power strip further comprises a first and a second digital encoder, wherein the first and second digital encoders are moveable between:

a. a first position that corresponds to a standard mode in which each outlet in the first plurality of outlets activates sequentially after the passage of a predetermined time delay once the first controller receives a first signal to begin to sequence the first plurality of outlets;

b. a second position that corresponds to an instant on mode in which when the first power strip is turned on the first plurality of outlets will automatically activate sequentially after the passage of a predetermined time delay; and c. a third position that corresponds to an always on mode in which one of the first plurality of outlets is always on and the remaining first plurality of outlets activates sequentially after the passage of a predetermined time delay once the first controller receives the first signal to begin to sequence the first plurality of outlets.

17. The power strip of claim 13, wherein a power cord for the second power strip is plugged into one of the first plurality of outlets.

18. The power strip of claim 13, further comprising:

a. a first wireless chip mounted in the first housing and operatively coupled to the first controller;

b. a second wireless chip mounted in the second housing and operatively coupled to the second controller;

wherein when the first controller and the second controller are being operated wirelessly via a mobile computing device, the first power strip at least one digital encoder and the second power strip digital encoder are bypassed so that the first controller and the second controller respectively receive the first input signal and the second input signal from the mobile computing device.

19. The power strip of claim 13, further comprising a manual foot switch mounted to the first housing, wherein the manual foot switch is configured to generate a first activation signal that causes the first controller to activate the first sequence.

20. The power strip of claim 13, further comprising a first power quick connector mounted through the first housing, wherein the first power quick connector is configured to couple to a power cord of the second power strip.

* * * * *